US007108210B1

(12) United States Patent
Hugen

(10) Patent No.: US 7,108,210 B1
(45) Date of Patent: Sep. 19, 2006

(54) COMMINUTING MACHINE

(75) Inventor: Thomas Hugen, Wermelskirchen (DE)

(73) Assignee: Bernd Teller, Erkrath (DE)

( * ) Notice: Subject to any disclaimer, the term of this patent is extended or adjusted under 35 U.S.C. 154(b) by 15 days.

(21) Appl. No.: 10/088,029

(22) PCT Filed: Aug. 5, 2000

(86) PCT No.: PCT/EP00/07612

§ 371 (c)(1),
(2), (4) Date: Nov. 10, 2004

(87) PCT Pub. No.: WO01/19524

PCT Pub. Date: Mar. 22, 2001

(30) Foreign Application Priority Data

Sep. 11, 1999 (DE) ..... 199 43 518

(51) Int. Cl.
*B02C 18/16* (2006.01)

(52) U.S. Cl. ..... 241/86.1; 241/88.1; 241/89.3; 241/285.2; 241/74; 241/261.1

(58) Field of Classification Search ..... 241/285.2, 241/285.3, 261.1, 86.1, 88.1, 89.3, 74
See application file for complete search history.

(56) References Cited

U.S. PATENT DOCUMENTS 1,706,643 A * 3/1929 Wiley ..... 241/73
5,520,344 A * 5/1996 Fey et al. ..... 241/259.1

FOREIGN PATENT DOCUMENTS

DE 200307 A * 10/1938

* cited by examiner

*Primary Examiner*—Mark Rosenbaum
(74) *Attorney, Agent, or Firm*—Gudrun E. Huckett

(57) ABSTRACT

A comminution machine has a machine housing and a closed working cylinder with comminution holes arranged therein. Tools are arranged on a coaxial shaft within the working cylinder. The tools have vanes revolving at a spacing of at most a diameter of the comminution holes practically contactless relative to the cylinder. The vanes have outer edges slanted counter to a relative rotational direction between cylinder and tools. The shaft orientation and the axial orientation of the cylinder deviate from a vertical line. The working cylinder has a first end face opening connected to a feed channel and a lower cylinder half connected to a removal channel. A second end face opening whose diameter is at least as large as the greatest diameter of the working cylinder, is closed by a freely accessible lid. The shaft extends from the feed channel to the lid but does not penetrate the lid.

15 Claims, 5 Drawing Sheets

COMMINUTING MACHINE

BACKGROUND OF THE INVENTION

1. Field of the Invention

The present invention relates to a comminuting machine comprising a closed working cylinder, having comminution holes and comprised of material with inherent stiffness, and comprising tools, arranged within the working cylinder and rotating relative to the working cylinder. The tools are seated on a shaft coaxial to the working cylinder and have vanes which revolve at a spacing of at most the diameter of the comminution holes practically contactless relative to the working cylinder and are slanted with their outer edges counter to the relative rotational direction. A machine housing which is connected to a channel system between a feed channel and a removal channel is provided.

2. Description of the Related Art

Such comminuting machines serve for comminuting soft to medium hard comminution material. For this purpose, a closed working cylinder provided with comminution holes is provided which is usually comprised of stainless steel.

In the interior of the working cylinder, tools are arranged which extends parallel to the surface lines of the working cylinder and rotate relative to the working cylinder at an at most minimal spacing from the wall of the working cylinder.

This relative rotation can be generated, on the one hand, for a stationary working cylinder with rotating tools and, on the other hand, with stationary tools and a rotating working cylinder. Moreover, working cylinder and tools can rotate independently, respectively, and in opposite directions to one another.

During this relative rotation the material to be comminuted is displaced by the tools in the direction toward the inner wall of the working cylinder and is thereby chipped by the comminution holes, as desired.

Such comminution machines, on the one hand, can operate in batch operation and, on the other hand, can be part of a stationary or quasi-stationary process.

In both situations the machine housing of the comminution machine is connected between a feed channel and a removal channel. In the case of a pure batch machine, the feed channel can be, for example, in the form of a fill hopper or the like, while in the case of stationary or quasi-stationary processes a continuous material flow is guided into the comminution machine via the feed channel.

Such comminution machines occasionally also require cleaning and maintenance.

For this purpose, the tools and working cylinder must be demounted.

This is occasionally a problem in conventional comminution machines because demounting of tools and working cylinder requires at the same time also demounting of the feed channel and the removal channel, respectively.

In this connection, granulating friction devices are known in which the orientation of the shaft on which the tools are fastened and the axial orientation of the working cylinder are vertical.

In this situation, the working cylinder and the tools, however, can be removed only vertically from the machine housing so that it is mandatory to also demount the feed channel and the removal channel, respectively.

However, this basic principle of the configuration should not necessarily be abandoned because in such comminution machines the principle of gravity feed has indeed proven successful. The goods to be processed herein according to this conveying principle are moved without any additional energy on their way from the feed channel to the removal channel, and, in this way, are forced through the working cylinder.

Moreover, so-called nibblers are known with which lumps and agglomerates can be comminuted. Even though the working principal is based on cutting and slicing, the working cylinders of such nibblers are usually not closed.

Moreover, such nibblers serve primarily for granulating goods which are present before the processing step in the form of lumps, clods, and agglomerates.

Moreover, sifting machines are known in which this screen is of a straight-cylindrical shape and has rotating tools in its interior. This device serves only for sifting predetermined particle sizes, wherein the material to be sifted is transported by means of feed screws or the like, specially provided for this purpose, into the interior of the screen.

However, special mention should be made of the fact that the tools of such sifting machines must rotate practically with wall contact in order to prevent the screen from becoming clogged.

Otherwise, such screens are relatively soft with regard to bending and cannot be used for cutting purposes for comminuting the material to be processed.

Accordingly, in such sifting machines the vane-shaped tools extend parallel to the surface lines of the screen cylinder but relative to the axis of rotation exactly radially because it is important that the material to be sifted can be pushed forwardly unhindered.

SUMMARY OF THE INVENTION

It is therefore an object of the present invention to further develop the known comminution machines, which are known under the term granulating friction devices, such that, on the one hand, the installation in a processing line is possible and, on the other hand, a fast and problem-free exchange of working cylinder and tools is made possible.

This object is solved according to the invention in that the orientation of the shaft and the axial orientation of the working cylinder extend so as to deviate from a vertical line and that an end face opening of the working cylinder is connected to the feed channel and the lower cylinder half of the working cylinder is connected to the removal channel, and in that the other end face opening of the working cylinder is closed by a freely accessible lid, wherein the diameter of this end face opening is at least as large as the greatest diameter of the working cylinder, and in that the shaft, extending from the side of the feed channel, extends at most to the inner wall of the lid but does not penetrate it.

The invention has the advantage that the mounting and demounting of tools and working cylinder, even for a comminution machine arranged "inline" in a processing line, is possible at any time and without requiring additional demounting actions.

This advantage is achieved by a combination of features according to which firstly the orientation of the shaft and the axial orientation of the working cylinder extend so as to deviate from a vertical line.

With this measure it is possible to continue to employ the proven principle of gravity feed without the mounting or demounting direction of working cylinder and tools being positioned in a vertical line.

The mounting and demounting direction thus does not coincide with the material feeding path but instead crosses it at an acute to obtuse angle. By this feature, the required space for mounting and demounting is provided within the machine housing without requiring prior demounting of the feed channel or the removal channel.

Moreover, it is essential to arrange the feed channel on an end face opening of the working cylinder such that the material to be processed can reach the working cylinder by gravity feed. The removal of the comminuted goods must be carried out by means of a removal channel which is connected to the lower cylinder half of the working cylinder.

In this way it is achieved that the other end face opening of the working cylinder is closed off by a freely accessible lid whose diameter is at least as large as the greatest diameter of the working cylinder. Accordingly, the lid covers the opening in the machine housing provided for mounting and demounting, and, moreover, no additional functional drive parts or the like are connected to the lid. Accordingly, when the lid is removed, the working cylinder can be pulled out in the direction of the lid opening. On this side of the machine housing, the lid is completely freely accessible. It is clamped in a suitable way on the machine frame, for example, by an annular screw flange and seals accordingly the working chamber of the comminution machine hermetically. Additionally, the shaft should reach from the side of the feed channel at most to the inner wall of the lid but should not penetrate it.

Even though for constructive simplification, a floating shaft is preferred, a simple bearing receptacle for the shaft in the lid is also to be encompassed by the invention, at least in the sense that the shaft does not penetrate the lid.

In the case of an immobile working cylinder and rotatingly driven shaft, the rotary drive for the shaft is thus to be positioned on the side of the feed channel. The lid in this case therefore also serves for closing the working chamber and does not serve as a machine frame for guiding therethrough or supporting thereon shaft parts or the like.

The combination of all these features is decisive in connection with the invention and results in a working cylinder which is freely accessible from the side of the lid, wherein the working cylinder, when the lid is removed, can be pulled easily out of the housing, can be cleaned and then reinstalled again.

It is therefore important that for this process on the lid side of the machine housing no demounting measures must be undertaken because only the lid is to be removed in order to be able to access the working cylinder.

Accordingly, the tools and working cylinder can also be exchanged "inline", i.e., in the case of comminution machines which are installed in a processing line between a feed channel and a removal channel.

In addition, it can be provided to center the ends of the working cylinder on the end faces, respectively, in the machine housing, on the one hand, and in the lid, on the other hand. In this way, the lid takes on the double function, in addition to the hermetic sealing of the working chamber, of also positionally securing the mechanically stressed working cylinder such that the tools rotating relative thereto always have the same wall spacing from the working cylinder.

The revolving loads which result from this, in particular, in the area of the lower surface lines of the working cylinder, can be introduced by suitable centering devices via the lid into the machine housing.

When a local wear of the working cylinder in the area of its lower surface lines is to be prevented, it should be position-securable in several rotational positions so that, as a function of time, always additional surface lines will be in a bottom position in which area the material collection and thus the tool load is significantly greater than at other locations.

In order to avoid unnecessary bulges of the working cylinder during operation, the centering device should enclose the entire periphery of the working cylinder. This results in an extremely rigid, at least two-dimensional, clamping action which reliably prevents a local deflection of the working cylinder under the pressure of the tools.

In addition, it may be provided that the working cylinder is rotationally supported in its centering devices and that a driven rotational movement is imparted to it. In this way, the relative movement between working cylinder and tools is generated. In this connection the rotational drive for the working cylinder should be fastened on the machine frame where the free demounting of the lid is not impaired. The rotational drive can be in the form of a suitable positive-locking gear, for example, by means of gear wheels, wherein one of them is seated on the drive motor and the other on the outer periphery of the working cylinder.

When it is desired to rotationally drive the working cylinder while the tools are stationary and immobile, a uniform wear about the circumference results on the inner wall of the working cylinder. This is also the case when the tools additionally rotate in the counter direction to the working cylinder. However, the working speed then increases as a result of the higher relative speed between inner wall of the working cylinder and the tools.

A stationary and immobile working cylinder in which the tools are moving in rotation, however, has the advantage of minimal constructive expenditure and would appear to be the most cost-beneficial variant when employing very wear-resistant stainless-steel walls of which such working cylinders are conventionally comprised.

For avoiding deposits in the feed channel, the shaft should be substantially without steps in this area and in the adjoining working chamber. The rotational drive of the tools can be ensured by suitable positive-locking connections. Embodiments therefor are disclosed.

Expediently, for receiving the tools a separate rotor can be provided which is connected fixedly by a feather key with the shaft for torque transmission. The narrow fit between the rotor bore and the outer diameter of the shaft provides in this connection a soiling-free connecting seam in whose approximately central axial area the feather key is moreover arranged.

A further simplified configuration results by means of a floating arrangement of the shaft on the side of the feed channel. In this embodiment, the lid is exclusively a closure part for closing the working chamber and can therefore be embodied as a planar plate.

In this connection, the lid represents an annular screw-on flange which is screwed flat against an end face of the machine housing. The density of the fastening screws, i.e., their mutual circumferential spacing, is matched to the respective force conditions in the working chamber so that the lid together with the machine frame is practically a unitary stiff part.

When the tools with their transverse edge revolve on the inner side of the lid at a minimal spacing, this results in a deposit-free operation wherein expediently the tools revolve on the side opposite the lid of the housing on a housing wall provided thereat also at a minimal spacing. In this way, the entire working chamber is kept clean at the end faces while the active area between the tools and the working cylinder is located in the lower half of the cylinder.

When it is desired to keep the tendency of forming dead water zones and deposit zones at a minimum, a working cylinder of a straight cylindrical shape with a horizontally positioned cylinder axis is beneficial or a cone-shaped working cylinder whose lower surface line is positioned substantially horizontally.

The latter variant has the additional advantage that a certain axial component of mixing of the goods results which provides a more uniform material loading.

BRIEF DESCRIPTION OF THE DRAWINGS

In the following, the invention will be explained in more detail with the aid of embodiments. It is shown in.

DESCRIPTION OF PREFERRED EMBODIMENTS

Figure 1:
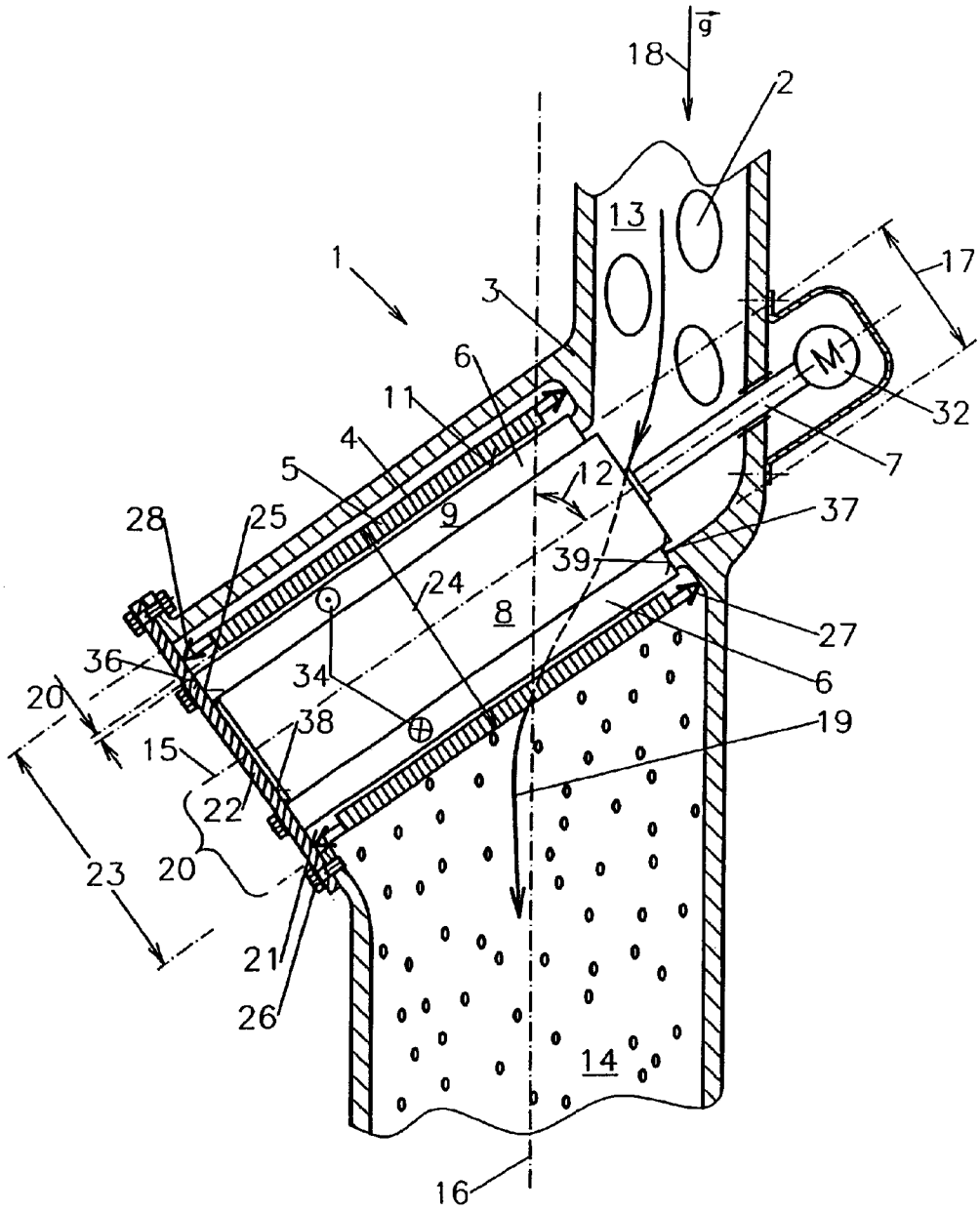
FIG. 1 a first embodiment of the invention.

If nothing to the contrary is mentioned, the following description applies to all Figures.

The Figures show a comminution machine 1 for comminuting soft to medium hard comminution material 2.

Such comminution machines are required in the pharmaceutical industry, the food industry, the chemical industry, and the cosmetics industry. They serve, for example, for comminuting conglomerates obtained in centrifuges. They serve for reducing materials of coarse particle size or elastic or sticky materials to a desired particle size, wherein the materials are then supplied to mixers, dryers or the like. Also, this processing can loosen powder-like or conglutinated material. Moreover, moist or dry products can be homogenized to an optimal particle size.

An important goal in this connection is the optimization of the products and the process properties of the materials to be comminuted with respect to the further processing.

The centerpiece of this comminution machine is a closed working cylinder 4 of a circular cross-section which in most cases is comprised of stainless-steel and in all cases has comminution holes 5. The wall thickness of the material is so thick that overall a very stiff cage results which is stationarily mounted relative to the machine housing 3.

The material thickness of the working cylinder ensures thus an inherently stiff configuration within which the tools 6 are arranged. The tools 6 and the working cylinder 4 rotate relative to one another so that in the area of the walls of the working cylinder 4 a shearing movement between the tools 6 and the comminution holes 5 results where the comminution material 2 is comminuted in the end.

The shaft 7, about which the tools 6 rotate, is principally arranged coaxially to the longitudinal axis of the working cylinder 4 so that the rotational path of the tools describe a cylinder concentric relative to the working cylinder 4 which has at most a spacing 10 as minimal as to the inner wall of the working cylinder 4.

The spacing 10 between the tools 6 and the inner wall of the working cylinder 4 therefore has a value between 0 and a few millimeters. As a standard value the spacing should be at most matching the diameter of the comminution holes 5 on which the material 2 is sheared off.

The comminution holes 5 can be a round hole, a friction hole or a square hole. In this way, the suitability of the comminution machine for almost any type of task is ensured.

In addition, the tools 6 with their outer edges 11 are slanted counter to the relative rotational directions 33 and 34, respectively, which results from the rotational movement (s) of the working cylinder 4 and the tools 6, respectively.

Accordingly, in the rotational direction narrowing wedge-shaped spaces are formed between the inner wall of the working cylinder 4 and the pressing surfaces of the tools 6, leading in the rotational direction, resulting in a forced peeling of the material on the comminution holes 5 of the working cylinder 4.

In this connection, there is substantially no contact between the outer edges 11 of the tools 6 and the inner wall of the working cylinder 4.

The machine housing 3 of this comminution machine 1 is connected between a feed channel 13 and a removal channel 14 to a channel system which, in the simplest case, is comprised of a fill hopper on the feed channel 13 and an outlet channel on the removal channel 14.

It is now important that the orientation 15 of the shaft 7 and the axial orientation 15 of the working cylinder 4 extend so as to deviate from a vertical line 16. The important slant angle 12 is greater than zero degrees and smaller than 180 degrees. It is preferably 90 degrees ±20 degrees.

Figure 2:
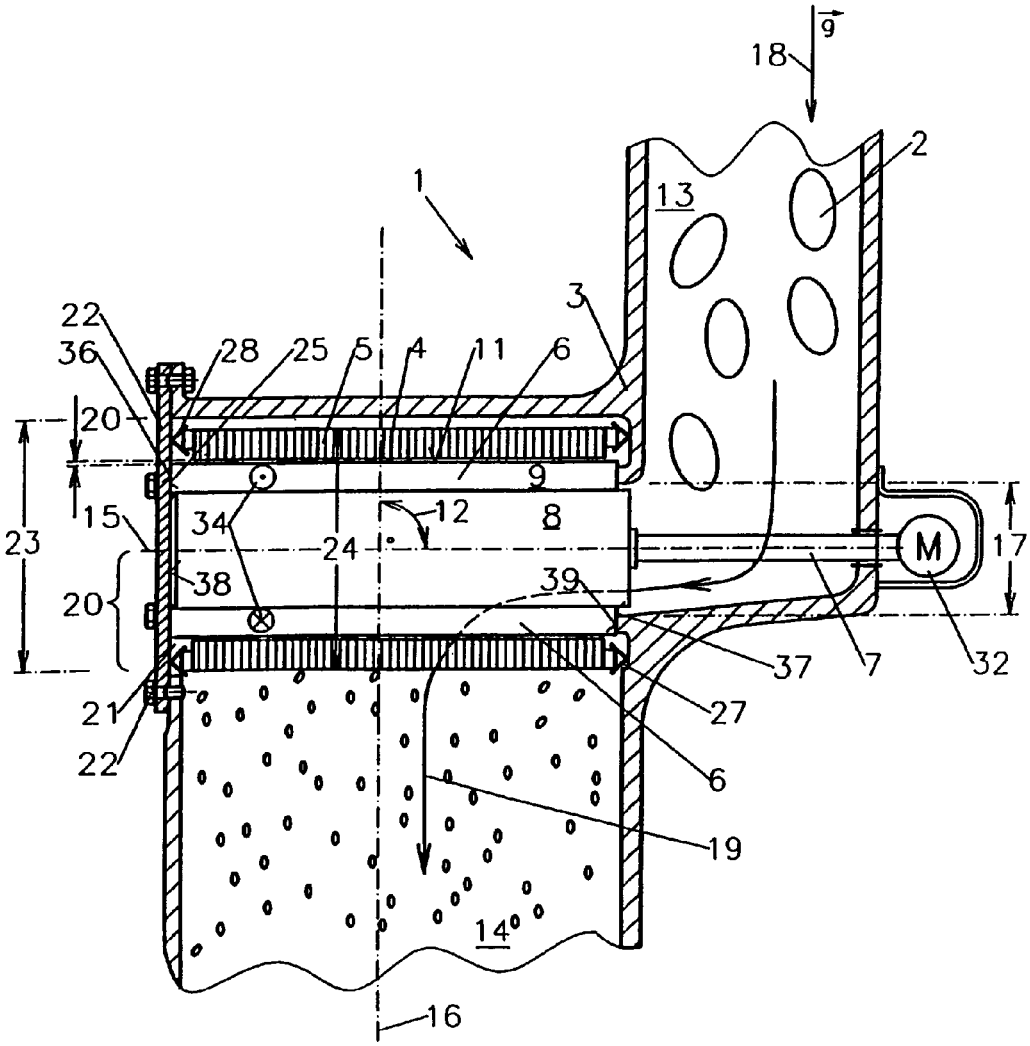
FIG. 2 a further embodiment of the invention.
Figure 3:
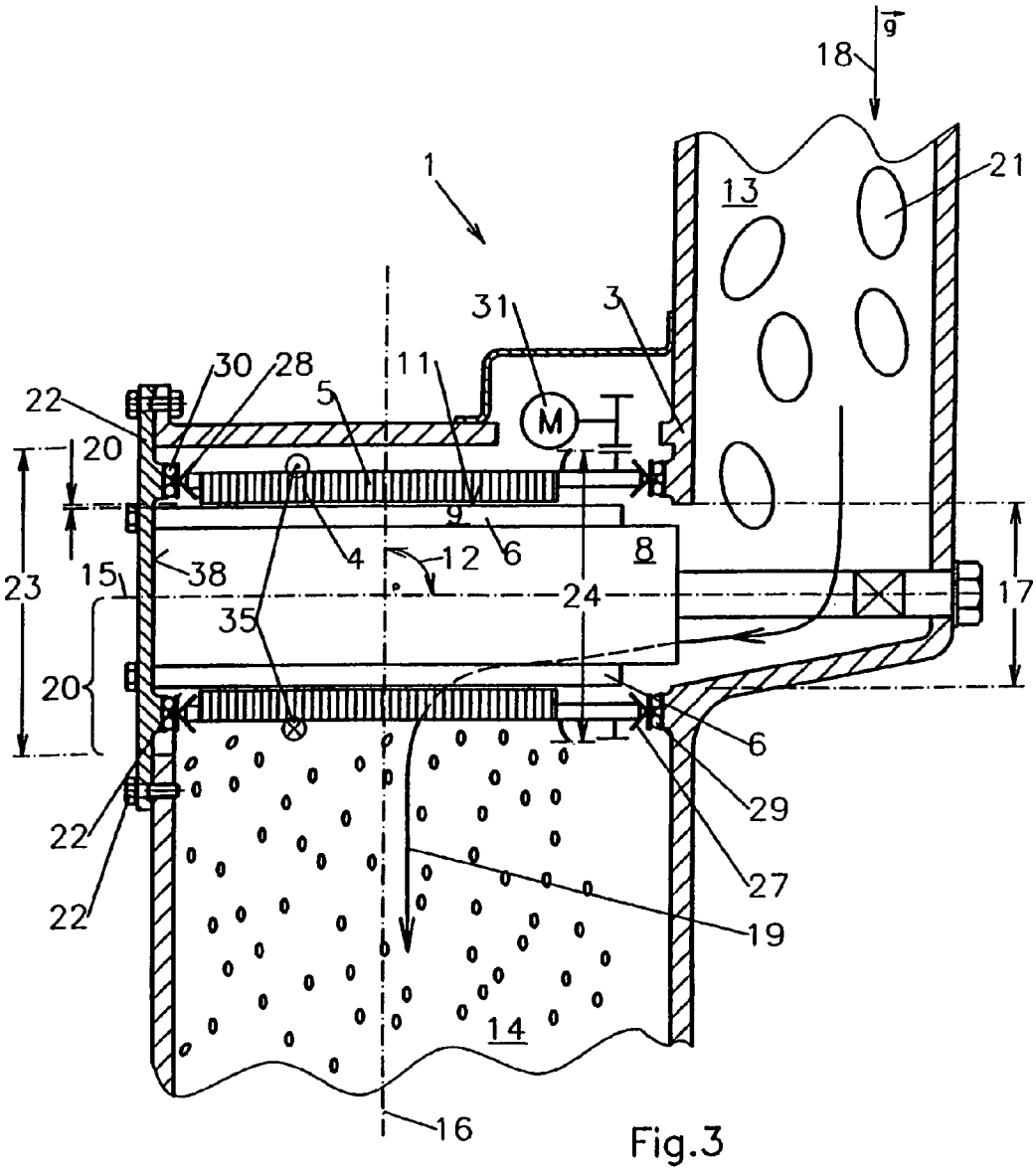
FIG. 3 yet another embodiment of the invention.
Figure 4:
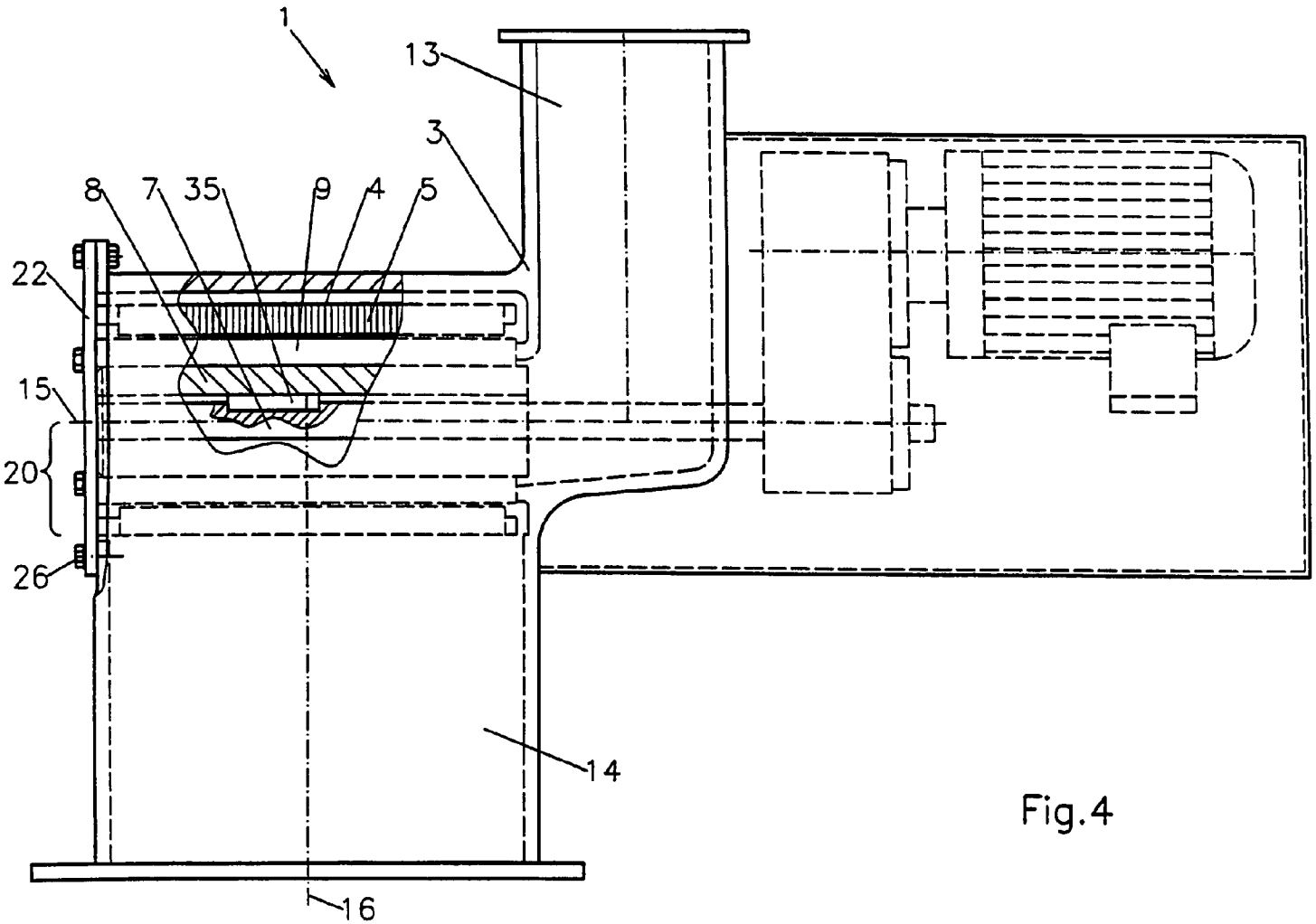
FIG. 4 one embodiment of the invention with intermediate gearbox
Figure 5:
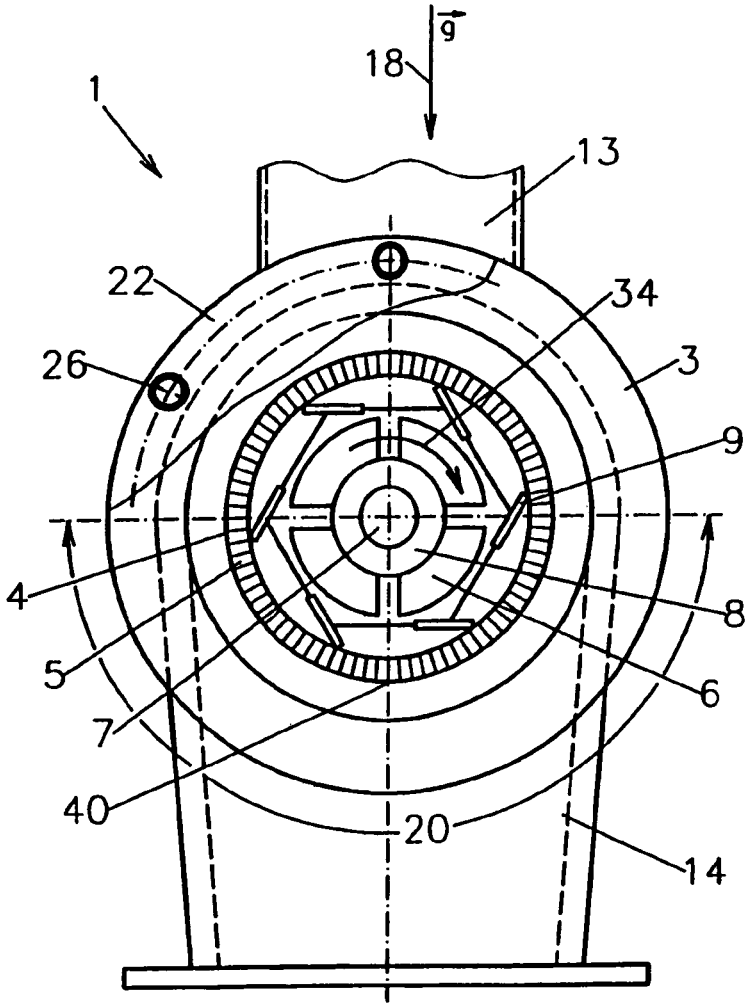
FIG. 5 a plan view onto the embodiment according to FIG. 4 in the viewing direction V—V.

In this way, between the orientation of the vertical line 16 and the orientation 15 an acute to obtuse angle results which is a right angle in the embodiments according to the FIGS. 2 through 4.

Moreover, the end face opening 17 of the work cylinder is connected to the feed channel 13. Accordingly, the comminution material 2 drops directly into the comminution chamber which is enclosed by the interior of the working cylinder 4.

The lower cylinder half 20 of the working cylinder 4 is connected to the removal channel 14 so that the comminuted material can fall along the material conveying path 19 determined by gravity 18 downwardly out of the machine housing 3.

Moreover, the other end face opening 21 of the working cylinder is closed by a freely accessible lid 22, and this lid 22 covers an opening 21 in the machine frame 3 whose diameter 23 is at least as large as the greatest diameter 24 of the working cylinder 4.

In this way, the working cylinder 4 and tools 6 are easily accessible for exchange and cleaning from the side of the lid without this requiring flange connections to be detached which secure the machine frame 3 between the feed channel 13 and the removal channel 14.

Moreover, the shaft 7 extends from the side of the feed channel 13 and at most approaches the inner wall 25 of the lid 22 but does not penetrate the lid 22.

The lid therefore provides a constructive closure of the machine frame on that side of the comminution chamber where no constructive bearings, drive positions etc. are provided.

The lid therefore can be removed by a simple release of the screws 26 from the machine housing in order to be able to thereafter remove the working cylinder 4 and optionally the tools 6.

In this connection, the lid 22 closes a diameter 23 of the opening in the machine housing 3 which is at least as large as the greatest diameter 24 of the working cylinder so that the working cylinder can be removed without problems from the interior of the machine housing 3 as soon as the lid has been unscrewed.

In addition to this, the FIGS. 1 through 3 show that one end of the working cylinder 4 is positioned in a centering device 27 which is provided stationarily on the machine housing 3. The centering device 27 is located in the area of the inlet opening of the feed channel 13 into the machine housing. The other end of the working cylinder 4 is secured in a corresponding centering device 28 which is provided directly on the lid 22. In the mounted state, between the centering devices 27 and 28 an axial spacing results which corresponds substantially to the axial length of the working cylinder 4 so that, when mounting the lid 22, also an axial fixation of the working cylinder 4 results.

In the embodiment of FIG. 1 and FIG. 2, an immobile working cylinder 4 is shown. Since the conveying action of the comminution material 2 is substantially realized by gravity, a certain material collection will always form in the area of the lower surface line 40 so that this will also be the zone of greatest material stress between the working cylinder 4 and the tools 6.

In order to generate a uniform wear about the inner circumference of the working cylinder 4, it is suggested that for an immobile working cylinder 4 a fixation of the working cylinder 4 in several rotational positions is made possible.

This is realized, for example, by a centering device 27 and 28, respectively, which in the circumferential direction is indifferent so that the working cylinder 4 can be secured in a plurality of possible rotational positions.

A centering device which engages the working cylinder at the end face over the entire circumference fulfills moreover the requirement of minimal dead space and prevents thus reliably unnecessary material collection.

Accordingly, within the comminution chamber no material will deposit, or at least only a minimal amount of material, so that the comminution result of many products is significantly improved in this way.

In supplementing this, FIG. 3 shows an embodiment in which the centering devices 27, 28 are seated in rotary bearings 29, 30, respectively so that the mounted and axially fixed working cylinder 4 can rotate in these rotary bearings 29 and 30, respectively.

For this purpose, an external rotary drive 31 is provided which engages the circumference of the working cylinder 4. The positive-locking drive is realized by means of a gearwheel/pinion pair wherein the gearwheel is seated on the periphery of the working cylinder 4 and has an outer diameter which is not greater than the diameter 23 of the lid opening in the machine frame 3.

Moreover, in this embodiment the condition is also fulfilled that the external rotary drive 31 of the working cylinder 4 does not affect the mounting of the lid 22. For this purpose, the external rotary drive 31 is fastened on the machine frame 3 in the longitudinal area of the working cylinder 4 and has no connection whatsoever to the lid 22.

In this embodiment, moreover, the conditions are fulfilled that the tools 6 are stationary and immobile and that the working cylinder 4 is driven in rotation.

The rotational direction 33 of the working cylinder 4 results from the angular position of the tools 6 wherein the one for the rotational directions between the vane 9 serving as the tool and the inner wall of the working cylinder 4 is decisive.

Moreover, it is easily conceivable to rotate the tools 6 also in the embodiment according to FIG. 3 in a direction which is counter to the rotational direction of the working cylinder 4.

This measure serves, on the one hand, for avoiding locally limited wear of the working cylinder 4 in the area of its lower surface line 40 and, at the same time, for providing an increase of its processing speed because the relative speed between the inner wall of the working cylinder 4 and the outer edge 11 of the vane 9 is increased.

A constructively very simple solution is illustrated in FIGS. 1 through 2 and FIGS. 4 to 5.

Here, the working cylinder is stationary and immobile and the tools 6 are driven in rotation in the rotational direction 34. An external rotary drive 32 is provided as the drive and is anchored on the machine frame 3.

The drive 32 is seated on the side of the machine frame 3 facing the feed channel 13 so that the shaft 7 penetrates the feed channel 13.

In addition, the shaft 7 in the area of the feed channel 13 is free of shaft steps in order to prevent the deposition of material.

In this connection, FIG. 4, in particular, shows that the tools 6 are vane-shaped and are seated on the periphery of a separate rotor 8 which is fixedly connected by a feather key 35 to the shaft 7 for torque transmission.

In this way it is achieved, on the one hand, that the rotor 8 can perform in the axial direction a compensation movement within the machine housing 3 while, on the other hand, it must follow the rotational movement of the shaft 7. For this purpose, the rotor has a longitudinal groove which is matched to the width of the feather key 35 so that the rotor in the axial direction can ride on the shaft 7. In this connection it is adjusted such that the vanes 9 adjust themselves precisely between their transverse edge 36 at the lid and their transverse edge 35 at the machine frame within the working chamber.

As a result of the free movability, the system comprised of the shaft, the rotor with vanes, and the working chamber is free of any restraints and finds a practically force-free position that is substantially wear-free.

For this reason, it is recommended to support the shaft 7 outside of the feed channel on the side facing the external rotary drive 32 in a floating arrangement. A support of the system on the lid 22 is not required.

The illustrated embodiments show also that the lid 22 is screwed with an end face 38 flat against a correlated surface at the end of the machine housing.

Since the contact surface 38 is planar and flat, the tools 6 can therefore rotate with their transverse edge 36 on the inner surface of the lid 22 at a spacing as minimal as possible while avoiding surface contact.

This measure serves for preventing deposits because the areas across which the tools 6 pass are always scraped free.

In addition to this, it can be provided that on the side of the machine frame 3 opposite the lid 22 a flat housing wall 39 is provided on which the oppositely positioned transverse edges 37 of the tools 6 circulate at a spacing as minimal as possible while avoiding surface contact. In this embodiment it is also true that this measure is provided for preventing deposits.

While all Figures show working cylinders 4 which have a straight-cylindrical contour, in the case of FIG. 1 the orientation of the shaft 7 and working cylinder 4 relative to the vertical line 16 is such that in the direction of the material conveying path 19 the working cylinder 4 is slanted at an acute angle to the vertical line in a downward direction.

In contrast to this, in the embodiments of FIGS. 2 to 4, the orientation of the shaft 7 and the axial orientation of the working cylinder are horizontal.

The working cylinder in all embodiments is straight-cylindrical.

However, the invention also includes embodiments in which the working cylinder 4 is conical. In particular, a working cylinder 4 is oriented such that the lower surface line 40 extend horizontally or at an angle of less than approximately 30 degrees to the horizontal line.

LIST OF REFERENCE NUMERALS

1 comminution machine
2 comminution material
3 machine frame, machine housing
4 working cylinder
5 comminution holes
6 tools
7 shaft
8 rotor
9 vane
10 spacing working cylinder-vane
11 outer edge
12 slant angle
13 feed channel
14 removal channel
15 orientation of 4 or 7
16 vertical line
17 first end face opening
18 gravity
19 material conveying path
20 lower cylinder half
21 second end face opening
22 lid
23 diameter of the opening
24 largest diameter of the working cylinder
25 inner wall of the lid
26 lid screw
27 centering device in the machine housing
28 centering device in the lid
29 rotary bearing of 27
30 rotary bearing of 28
31 external rotary drive of the working cylinder
32 external rotary drive of the tools
33 rotational direction of 4
34 rotational direction of 6
35 feather key
36 transverse edge on the side of the lid
37 transverse edge on the side of the machine frame
38 end face of the lid
39 flat housing wall of the machine frame
40 lower surface line

What is claimed is:

1. A comminution machine for comminuting soft to medium hard comminution material, the comminution machine comprising:

a machine housing;

a feed channel and a removal channel connected to the machine housing;

a closed working cylinder, having comminution holes and comprised of material with inherent stiffness, arranged in the machine housing;

a shaft coaxially arranged to the working cylinder, tools mounted on the shaft and rotating relative to the working cylinder;

wherein the tools have vanes revolving at a spacing of at most a diameter of the comminution holes practically contactless relative to the working cylinder;

wherein the vanes have outer edges slanted counter to a relative rotational direction between the working cylinder and the tools;

wherein an orientation of the shaft and an axial orientation of the working cylinder deviate from a vertical line;

wherein the working cylinder has a first end face opening connected to the feed channel;

wherein the working cylinder has a lower cylinder half connected to the removal channel;

wherein the working cylinder has a second end face opening closed by a freely accessible lid, wherein the diameter of the second end face opening is at least as large as the greatest diameter of the working cylinder;

wherein the shaft extends from the feed channel to the lid at most to an inner wall of the lid but does not penetrate the lid;

wherein the working cylinder has a first end and a second end, wherein the first end of the working cylinder is centered in the machine housing in the area of an inlet opening of the feed channel and wherein the second end of the working cylinder is centered in the lid, wherein the lid axially secures the working cylinder;

wherein the working cylinder is immobile during comminution and configured to be fixed in several rotational positions.

2. The comminution machine according to claim 1, further comprising centering devices, wherein the first and second end faces of the working cylinder are clamped over the entire periphery of the first and second end faces by the centering devices.

3. The comminution machine according to claim 1, wherein during comminution the tools are driven in rotation.

4. The comminution machine according claim 1, wherein the shaft penetrates the feed channel and is free of shaft steps in the feed channel.

5. The comminution machine according to claim 4, further comprising a separate rotor, wherein the tools are seated on a periphery of the separate rotor, wherein the separate rotor is fixedly connected by a feather key to the shaft for torque transmission.

6. The comminution machine according to claim 4, wherein the shaft is supported outside of the feed channel in a floating arrangement.

7. The comminution machine according to claim 1, wherein the lid is connected with one end face flat against a counter surface of the machine frame by a screw connection.

8. The comminution machine according to claim 7, wherein the tools have first transverse edges positioned on an inner side of the lid , wherein the first transverse edges rotate across the inner side at a spacing as minimal as possible relative to the inner side of the lid without contacting the inner side.

9. The comminution machine according to claim 8, wherein the machine housing has a flat housing wall on a side of the machine housing opposite the lid, wherein the tools have second transverse edges positioned on the flat housing wall, wherein the second transverse edges rotate at a spacing as minimal as possible to the flat housing wall without contacting the flat housing wall.

10. The comminution machine according claim 1, wherein the working cylinder is straight-cylindrical and the orientation of the shaft and the axial orientation of the working cylinder are horizontal.

11. The comminution machine according claim 1, wherein the working cylinder is conical.

12. The comminution machine according to claim 11, wherein a lower surface line of the working cylinder is positioned relative to a horizontal line at an angle between zero degrees and approximately 30 degrees.

13. A comminution machine for comminuting soft to medium hard comminution material, the comminution machine comprising:

a machine housing;

a feed channel and a removal channel connected to the machine housing;

a closed working cylinder, having comminution holes and comprised of material with inherent stiffness, arranged in the machine housing;

a shaft coaxially arranged to the working cylinder, tools mounted on the shaft and rotating relative to the working cylinder;

wherein the tools have vanes revolving at a spacing of at most a diameter of the comminution holes practically contactless relative to the working cylinder;

wherein the vanes have outer edges slanted counter to a relative rotational direction between the working cylinder and the tools;

wherein an orientation of the shaft and an axial orientation of the working cylinder deviate from a vertical line;

wherein the working cylinder has a first end face opening connected to the feed channel;

wherein the working cylinder has a lower cylinder half connected to the removal channel;

wherein the working cylinder has a second end face opening closed by a freely accessible lid, wherein the diameter of the second end face opening is at least as large as the greatest diameter of the working cylinder;

wherein the shaft extends from the feed channel to the lid at most to an inner wall of the lid but does not penetrate the lid;

wherein the working cylinder has a first end and a second end, wherein the first end of the working cylinder is centered in the machine housing in the area of an inlet opening of the feed channel and wherein the second end of the working cylinder is centered in the lid, wherein the lid axially secures the working cylinder;

centering devices clamping the first and second end faces of the working cylinder over the entire periphery of the first and second end faces;

wherein the centering devices are rotatably supported and the working cylinder has an external rotary drive which engages the working cylinder without interfering with a mountability of the lid.

14. The comminution machine according to claim 13, wherein the tools are stationary and immobile during comminution and the working cylinder is rotatingly driven relative to the tools.

15. The comminution machine according to claim 13, wherein the working cylinder and the tools are driven independently and in opposite directions relative to one another.

* * * * *